US009670608B2

(12) United States Patent
Nakajima et al.

(10) Patent No.: US 9,670,608 B2
(45) Date of Patent: Jun. 6, 2017

(54) SEWING MACHINE

(71) Applicant: JANOME SEWING MACHINE CO., LTD., Tokyo (JP)

(72) Inventors: Makoto Nakajima, Sagamihara (JP); Mikio Koike, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 14/845,654

(22) Filed: Sep. 4, 2015

(65) Prior Publication Data

US 2016/0251791 A1 Sep. 1, 2016

(30) Foreign Application Priority Data

Feb. 26, 2015 (JP) ..... 2015-036235

(51) Int. Cl.
*D05B 27/02* (2006.01)
*D05B 69/02* (2006.01)

(52) U.S. Cl.
CPC ..... *D05B 27/02* (2013.01); *D05B 69/02* (2013.01); *D05D 2209/16* (2013.01)

(58) Field of Classification Search
CPC ..... D05B 27/02; D05B 69/00; D05B 69/02; D05B 69/04; D05B 69/16; D05B 69/30; D05B 69/34; D05B 2209/16; F16H 2007/0842; F16H 2007/0846
See application file for complete search history.

(56) References Cited

U.S. PATENT DOCUMENTS 2,121,080 A * 6/1938 Galkin ..... D05B 69/30 474/136
4,924,788 A * 5/1990 Brown ..... D05B 57/36 112/182
4,934,989 A * 6/1990 Furukawa ..... F16H 7/1281 474/135
5,221,236 A * 6/1993 Raymer ..... B62M 9/16 474/109
5,555,829 A * 9/1996 Katou ..... D05B 69/12 112/220
6,904,853 B2 * 6/2005 Chen ..... D05B 69/00 112/220
7,597,058 B2 * 10/2009 Ishikawa ..... D05B 3/02 112/190
8,353,795 B2 * 1/2013 Montani ..... F16H 7/1281 474/118

FOREIGN PATENT DOCUMENTS

DE 102007031072 A1 * 2/2008
JP 2000-042270 A 2/2000
JP 2013-179980 A 9/2013

* cited by examiner

*Primary Examiner* — Ismael Izaguirre
(74) *Attorney, Agent, or Firm* — Nath, Goldberg & Meyer; Jerald L. Meyer

(57) ABSTRACT

A sewing machine includes an upper shaft rotatable so as to drive a needle bar, a lower shaft rotatable so as to drive a feed dog, an upper-shaft pulley provided for the upper shaft, a lower-shaft pulley provided for the lower shaft, a belt linking the upper-shaft pulley with the lower-shaft pulley to synchronize respective rotations, and a belt adjusting mechanism contacting the belt and changing a belt length at a tensioned side of the belt where the belt is drawn in.

7 Claims, 5 Drawing Sheets

NEEDLE THREAD IS HELD BETWEEN NEEDLE PLATE AND CLOTH

INFECTION OF THREAD IS LITTLE

SEWING MACHINE

CROSS-REFERENCE TO RELATED APPLICATION(S)

This application is based upon and claims the benefit of priority from Japan Patent Application No. 2015-036235, filed on Feb. 26, 2015, the entire contents of which are incorporated herein by reference.

FIELD OF THE INVENTION

The present invention relates to a sewing machine that includes a structure which can adjust a timing at which a feed dog feeds a cloth.

BACKGROUND

Sewing machines include a cloth feeding mechanism that feeds a cloth in a horizontal direction. The cloth feeding mechanism includes a feed dog, and the cloth is fed in the horizontal direction by this feed dog that comes out from the opening of a needle plate. The cloth feeding mechanism includes a structure that drives the feed dog. For example, a structure is known in which a feed rod is coupled with a main shaft of a sewing machine, and this feed rod is linked with the feed dog via an eccentric cam to drive the feed dog. When the main shaft is rotated by the drive of the sewing machine, the feed rod is rotated, and thus the feed dog is moved while tracing a motion trajectory by the eccentric cam.

In addition, as the structures that drive the feed dog, some sewing machines are provided with a motor that moves the feed dog up and down, and a motor that moves the feed dog in the horizontal direction. By controlling those motors through the CPU of the sewing machine, the feed dog can be driven with a proper motion trajectory.

When sewing is performed by using a sewing machine, the level of which the feed dog gets into a cloth and force to move the cloth change due to the thickness of a cloth to be sewn and the material thereof, and the like. When the feed dog is not moved while drawing a proper motion trajectory relative to the cloth to be sewn, the cloth is shrunk, and the sewing quality decreases. Hence, the motion trajectory of the feed dog is adjusted in accordance with the thickness of the cloth.

According to the cloth feeding mechanism that utilizes the eccentric cam, however, it is necessary for an operator to manually adjust the eccentric cam to change the motion trajectory. Hence, adjustment of the eccentric cam is a burden operation for the operator, and it is necessary to adjust the motion trajectory of the feed dog every time the cloth to be sewn is changed. This makes the sewing work complicated. In addition, according to the cloth feeding mechanism that utilizes the eccentric cam, the upper shaft and the lower shaft operate in conjunction with each other, and thus the phase to feed the feed dog is unchangeable.

According to the cloth feeding mechanism that utilizes the motors, the motion trajectory is to be adjusted through the independent motors, and thus a phase difference may be caused relative to the upper shaft that drives the needle bar. Accordingly, it is difficult to move the cloth at the optimized phase.

The present invention has been proposed to address the above-explained problems of conventional technologies, and it is an objective of the present invention to provide a sewing machine provided with a mechanism that can control a timing at which a feed dog feeds a cloth without a complicated adjustment work.

SUMMARY OF THE INVENTION

To accomplish the above objective, a sewing machine according to an aspect of the present invention includes:

an upper shaft rotatable so as to drive a needle bar;

a lower shaft rotatable so as to drive a feed dog;

an upper-shaft pulley provided for the upper shaft;

a lower-shaft pulley provided for the lower shaft;

a belt linking the upper-shaft pulley with the lower-shaft pulley to synchronize respective rotations; and a belt adjusting mechanism contacting the belt and changing a belt length at a tensioned side of the belt where the belt is drawn in.

When the belt adjusting mechanism changes the belt length at the tensioned side so as to elongate the belt length, a feeding phase of the lower shaft may be advanced relative to a thread take-up lever linked with the upper shaft.

The belt adjusting mechanism may include at least one idler that contacts the belt at the tensioned side, and the belt length of the belt at the tensioned side may be changed by the idler that is swingable.

The sewing machine may further include a tensioner that applies force to the belt in accordance with a change in the belt length. The tensioner may be provided at a loosened side of the belt where the belt is drawn out. The tensioner may be an elastic member.

The sewing machine may further include a restrictor restricting a movable range of the tensioner when a tensioned condition of the belt exceeds the force by the tensioner. The restrictor may include a stopper arm, and a stopper disposed with a predetermined distance from the stopper arm, and the stopper arm may abut the stopper when the tensioned condition of the belt exceeds the force by the tensioner, thereby restricting the movable range of the tensioner.

According to the present invention, it becomes possible to provide a sewing machine that includes a structure which can control a timing at which a feed dog feeds a cloth without a complicated adjustment work.

BRIEF DESCRIPTION OF THE DRAWINGS

FIG. 3A illustrates a condition in which the idler is moving in a direction in which the idler pushes the tensioned side of a belt, while FIG. 3B illustrates a condition in which the idler is moving in a direction in which the idler pushes the loosened side of the belt;

DETAILED DESCRIPTION OF THE EMBODIMENTS

[1. First Embodiment]

[1.1 Structure]

Figure 1:
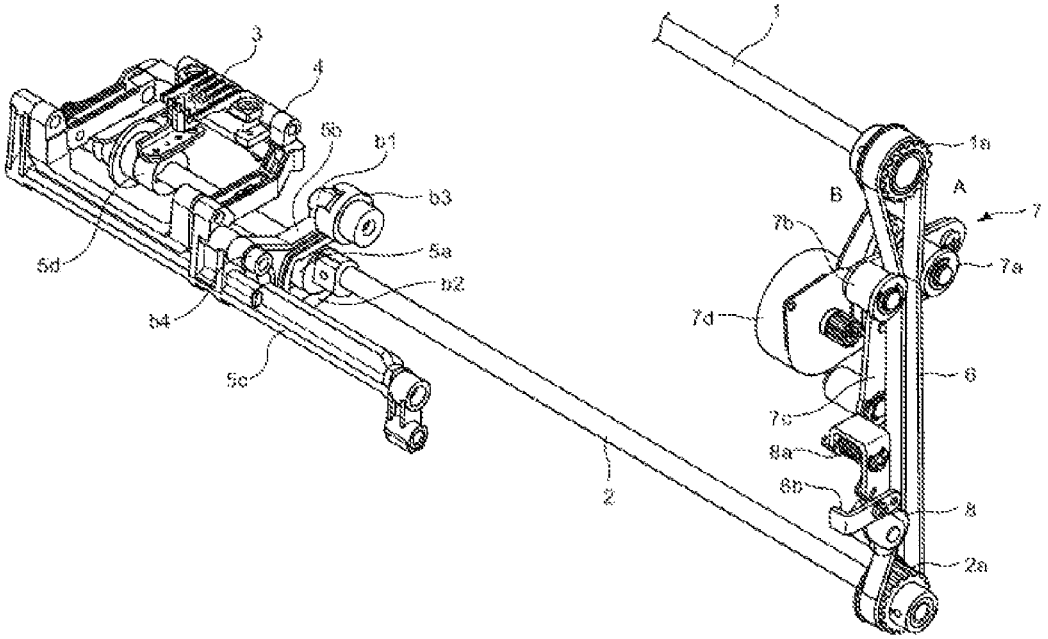
FIG. 1 is an explanatory diagram illustrating an example general structure of a sewing machine according to a first embodiment.

An embodiment of the present invention will be explained with reference to the figures. In the following explanation, a structure that adjusts a timing at which a cloth is fed in a sewing machine will be mainly explained. The explanation for the details of the structure of the sewing machine will be omitted, but the embodiment of the present invention is applicable to all sewing machines available currently or in future like a zig-zag stich sewing machine. FIG. 1 illustrates an example general structure of a sewing machine according to this embodiment.

(1) General Structure

The sewing machine 1 includes an upper shaft 1 and a lower shaft 2. The upper shaft 1 is linked with unillustrated needle bar and a thread take-up lever via a crank mechanism so as to be freely movable up and down. The needle bar supports a needle. The thread take-up lever changes the amount of a needle thread supplied to the needle.

The lower shaft 2 is linked with a feed dog 3 via a cam mechanism. The upper shaft 1 and the lower shaft 2 are freely rotatably supported by respective unillustrated bearings fixed to the interior of the sewing machine. Drive force from an unillustrated sewing machine motor is transmitted to the upper shaft 1. The crank mechanism of the upper shaft 1 converts the rotation of the upper shaft 1 into reciprocal motion, thereby moving the needle bar up and down.

The upper shaft 1 is provided with an upper-shaft pulley 1*a* that has a predetermined number of teeth. In addition, the lower shaft 2 is provided with a lower-shaft pulley 2*a* that has the same number of teeth as that of the upper-shaft pulley 1*a*. The upper-shaft pulley 1*a* and the lower-shaft pulley 2*a* are linked together through a toothed belt 6. The length of the toothed belt 6 is set to have a predetermined slack when the toothed belt 6 is engaged with the upper-shaft pulley 1*a* and the lower-shaft pulley 2*a*.

When the upper shaft 1 rotates, the upper-shaft pulley la also rotates, this rotation is transmitted to the lower-shaft pulley 2*a* through the toothed belt 6. Hence, the lower shaft 2 rotates at the same speed as that of the upper shaft 1. The cam mechanism of the lower shaft 2 moves the feed dog 3 up and down and horizontally together with the rotation of the lower shaft 2.

(2) Cloth Feeding Mechanism

The cloth feeding mechanism moves the feed dog 3 up and down and horizontally, and includes a feed stage 4, a feed cam 5*a*, a feed fork 5*b*, a horizontal feed rod 5*c*, and an up-and-down cam 5*d*. The feed dog 3 holds the cloth with an unillustrated cloth holder to feed the cloth, and, is attached to the feed stage 4. The feed stage 4 is linked with a mechanism that moves the feed dog 3 horizontally together with the feed stage 4, and a mechanism that moves the feed dog 3 up and down. The horizontal motion is a movement in the cloth feeding direction, and means a movement in the back-and-forth direction of the sewing machine.

As a mechanism that moves the feed dog 3 horizontally, the feed cam 5*a*, the feed fork 5*b*, and the horizontal feed rod 5*c* are linked. The feed cam 5*a* is attached to the lower shaft 2, and is rotated together with the rotation of the lower shaft 2. The feed fork 5*b* includes two arms b1, b2 opposite to each other, and the feed cam 5*a* is engaged between the two arms b1, b2. The arm b1 is provided with a protrusion. A cam b3 includes a groove engaged with the protrusion of the arm b1. The horizontal feed rod 5*c* is linked with the feed stage 4 and the feed fork 5*b*, and moves the feed stage 4 horizontally. The horizontal feed rod 5*c* is supported swingably by the frame of the sewing machine.

In addition, the feed fork 5*b* is attached to the horizontal feed rod 5*c* via a pin b4. This pin b4 becomes a center of rotation for the swing motion of the feed fork 5*b* when the feed cam 5*a* rotates. The groove of the cam b3 is formed in a shape that converts the vertical motion into the horizontal motion by causing the protrusion at the tip of the arm b1 to move along the grove of the cam b3 in the swing motion. According to the above-explained structure, the feed dog 3 is moved horizontally together with the feed stage 4 by the horizontal feed rod 5*c* that moves horizontally.

As a mechanism that moves the feed dog 3 up and down, the up-and-down cam 5*d* is linked. The up-and-down cam 5*d* is attached to the lower shaft 2, and rotates together with the rotation of the lower shaft 2. The up-and-down cam 5*d* is engaged with a lower face of the feed stage 4 which is the opposite surface to the surface to which the feed dog 3 is attached. The up-and-down cam 5*d* rotates together with the rotation of the lower shaft 2, and moves the feed dog 3 up and down together with the feed stage 4.

The feed stage 4, employing the structure that moves the feed dog 3 horizontally and the structure that moves the feed dog 3 up and down as explained above, is moved by the synthesis of the horizontal motion with the vertical motion. This synthesis motion enables the feed dog 3 to feed the cloth back and forth.

(2) Belt Adjusting Mechanism

A belt adjusting mechanism contacts the toothed belt 6 to adjust the belt length of the toothed belt 6 at the tensioned side, and has a function of correcting a timing at which the feed dog 3 feeds the cloth. In this embodiment, an explanation will be given of an idler unit 7 as an example. The idler unit 7 includes idlers 7*a*, 7*b* that contact a tensioned side A of the toothed belt 6 and a loosened side B thereof, respectively. It is appropriate if the idler unit 7 has at least one idler at the tensioned side A.

In this case, the tensioned side A of the toothed belt 6 means a side where the upper-shaft pulley 1*a* is newly meshed upon rotation of the upper-shaft pulley 1*a*, i.e., a side where the belt is drawn in. In addition, the loosened side B means a side where the meshing with the upper-shaft pulley 1*a* is disengaged, i.e., a side where the belt is drawn out. In the following explanation, the tensioned side A and the loosened side B are referred to as right and left, respectively in some cases.

The idlers 7*a*, 7*b* are disposed at the tensioned side A and the loosened side B so as to hold the toothed belt 6 therebetween from the outer circumference of the toothed belt 6. The idlers 7*a*, 7*b* are coupled with a motor 7*d* through an arm 7*c*. The idlers 7*a*, 7*b* swing, by drive force from the motor 7*d*, in synchronization with the vertical motion of the needle bar. When the idler unit 7 is operated, the slack of the toothed belt 6 is shifted toward the tensioned side A and the loosened side B. Hence, the belt length of the toothed belt 6 at the tensioned side A is changed. Accordingly, the timing of the upper shaft 1 and that of the lower shaft 2 is controlled, and thus a timing at which the feed dog 3 feeds the cloth is adjusted.

An example technology for adjusting the timing at which the feed dog 3 feeds the cloth is to load a predetermined program in the sewing machine, and to enable the operator of the sewing machine to select an appropriate timing depending on the cloth thickness, the material of the cloth, and the like. Alternatively, the cloth thickness may be detected automatically, and the idler unit 7 may be driven in accordance with a condition that is proper for the detected thickness.

(3) Tensioner

A tensioner absorbs a change in tension of the toothed belt 6 in accordance with a change in the belt length of the toothed belt 6 at the tensioned side A, thereby maintaining a constant belt tension of the toothed belt 6. In a precise sense, it is ideal that, for example, the tensioner is movable in accordance with a change in the absorbing level of the slack of the toothed belt 6 by the idler unit 7, and constant belt tension of the toothed belt 6 is maintained by using a tensioner that can apply certain force like a plumb bob. In this embodiment, however, an explanation will be given of an example case in which an elastic member, such as a spring or a cushion, which can obtain the same effect as that of a plumb bob is applied.

A tension adjusting idler 8 is provided at the loosened side B so as to contact the outer circumference of the toothed belt 6. The tension adjusting idler 8 is provided with an elastic member 8*a*. The elastic member 8*a* causes the tension adjusting idler 8 to push the loosened side B of the toothed belt 6 from the outer circumference side of the toothed belt 6 to the inner circumference side thereof. An example elastic member 8*a* is a spring or a cushion.

The tension adjusting idler 8 changes the tensioning position when the elastic member 8*a* is deformed in accordance with a change in the absorbing level of the slack of the toothed belt 6 by the idler unit 7. Hence, a fluctuation in the absorbing level of the slack can be reduced. In addition, the toothed belt 6 is tensioned toward the inner circumference side by the elastic force of the elastic member 8*a*, and thus the constant belt tension can be maintained.

Figure 2:
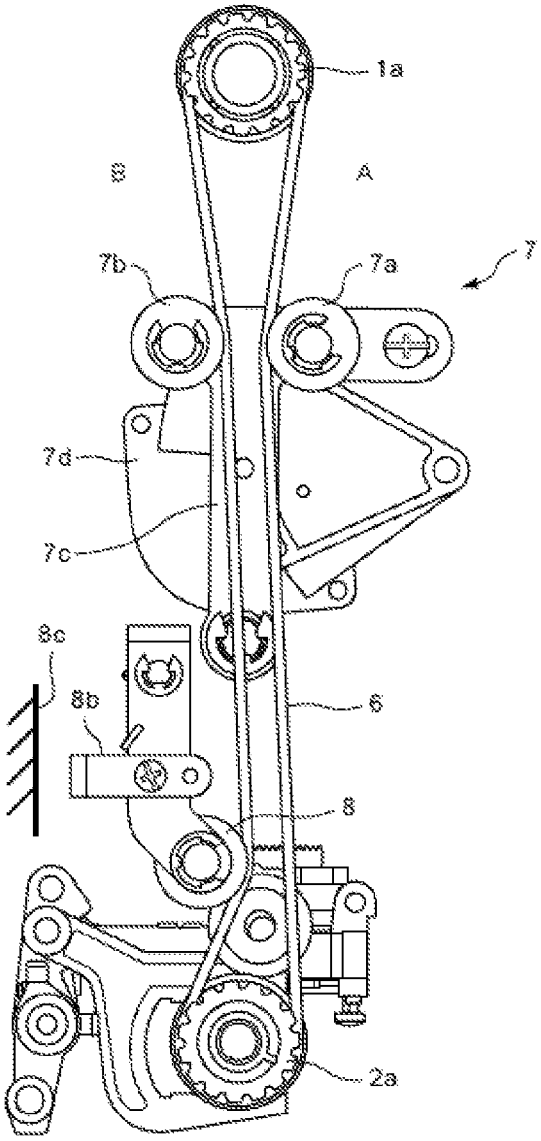
FIG. 2 is an explanatory diagram illustrating an example general structure of the sewing machine according to the first embodiment.

Moreover, a restrictor that restricts the movable range of the elastic member 8*a* when the tensioned condition of the toothed belt 6 exceeds the pushing force by the elastic member 8*a* is provided. In this embodiment, as illustrated in FIG. 2, the restrictor includes a stopper arm 8*b*, and, a stopper 8*c* disposed so as to have a predetermined distance from the stopper arm 8*b*. The stopper arm 8*b* is provided so as to be directed in the opposite direction to the tensioning direction of the elastic member 8*a*. The stopper 8*c* is disposed at a distance from the stopper arm 8*b* so as to contact the stopper arm 8*b* when the tensioned condition of the toothed belt 6 exceeds the pushing force of the elastic member 8*a*.

[1.2 Operation]

A cloth feeding operation by the above-explained sewing machine when sewing is performed by the sewing machine will be explained below.

(1) Cloth Feeding Operation

When the upper shaft 1 is driven for the sewing operation, the crank mechanism converts the rotation of the upper shaft 1 into the reciprocal motion, and thus the needle bar is moved up and down. In addition, the rotation of the upper shaft 1 is transmitted to the lower shaft 2 through the upper-shaft pulley 1*a*, the toothed belt 6, and the lower-shaft pulley 2*a*. When the lower shaft 2 is rotated by the rotation of the upper shaft 1, the feed cam 5*a* and the up-and-down cam 5*d* are rotated.

When the feed cam 5*a* rotates, the feed fork 5*b* swings around the pin b4. In this swing motion, the protrusion provided at the tip of the arm b1 moves along the groove of the cam b3, and thus the motion in the vertical direction is converted into the motion in the horizontal direction. Hence, the feed dog 3 is moved in the horizontal direction together with the feed stage 4 by the horizontal feed rod 5*c* that moves in the horizontal direction. In addition, when the up-and-down cam 5*d* rotates, the feed dog 3 is moved in the vertical direction together with the feed stage 4. By synthesizing the motion in the horizontal direction and the motion in the vertical direction as explained above, the feed dog 3 feeds the cloth back and forth.

(2) Motion Trajectory when Belt Adjusting Mechanism is Applied

The belt adjusting mechanism changes the belt length of the toothed belt 6 at the tensioned side, thereby adjusting the timing at which the feed dog 3 feeds the cloth. First, when the idler unit 7 is located at the center position, and no tension is applied to both of the tensioned side and the loosened side, the lower shaft 2 rotates together with the rotation of the upper shaft 1, and the feed dog 3 feeds the cloth at a predetermined timing.

Figure 3A:
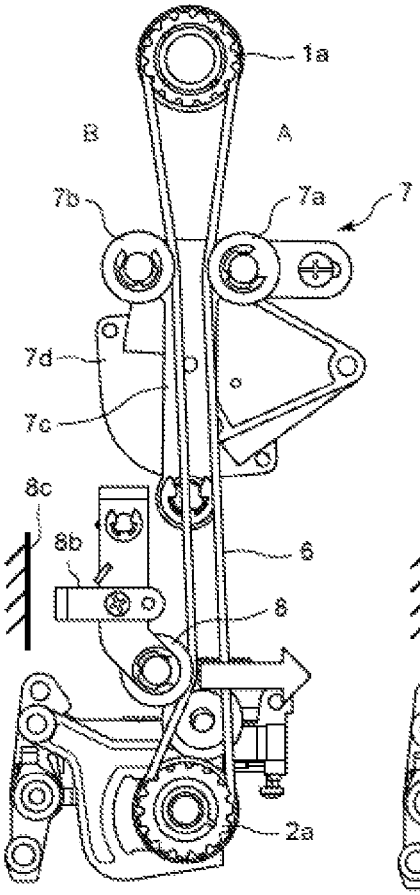
FIGS. 3A and 3B are explanatory diagrams illustrating an example operation of an idler.

Next, an explanation will be given when the idler unit 7 swings side by side. FIG. 3A illustrates a case in which the idler unit 7 is moved to the left. The expression "moved to the left" means a case in which the idler unit 7 swings to the loosened side B, and is moved in the direction in which the idler 7*a* pushes the tensioned side A of the toothed belt 6. In this case, the slack of the toothed belt 6 is shifted to the loosened side B, and in comparison with a case in which the idler unit 7 is located at the center position, the phase difference between the upper shaft 1 and the lower shaft 2 occurs. That is, the phase difference of the lower shaft 2 is caused relative to the thread take-up lever linked with the upper shaft 1.

Figure 4:
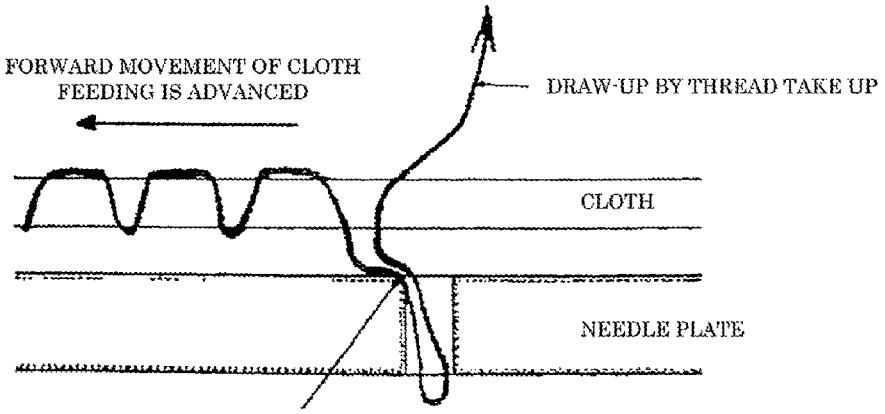
FIG. 4 is a diagram illustrating a condition of a needle thread drawn up by a thread take-up lever when the sewing machine is driven so as to advance a timing at which a cloth is fed.

When the idler unit 7 is moved to the left, the feeding phase of the lower shaft 2 is advanced relative to the thread take-up lever linked with the upper shaft 1. In this case, as illustrated in FIG. 4, the forward movement of the cloth becomes fast, and thus the needle thread is held between the needle plate and the cloth. Hence, the needle thread drawn up by the thread take-up lever has a resistance, and thus a stitch becomes looser in comparison with a case in which the idler unit 7 is located at the center position. Accordingly, by moving the idler unit 7 to the left if the cloth is thin and cloth shrinkage is likely to occur, the cloth is prevented from being shrunk by a stitch.

Figure 3B:
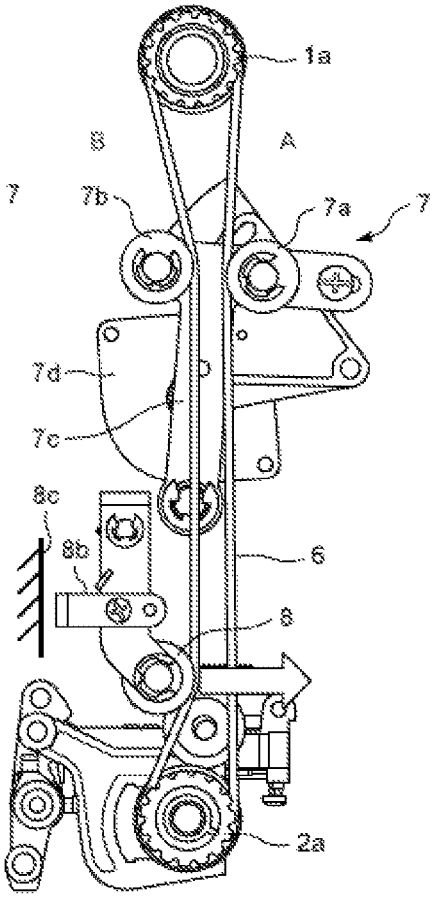

FIG. 3B illustrates a case in which the idler unit 7 is moved to the right. The expression "moved to the right" means a case in which the idler unit 7 swings to the tensioned side A, and is moved in the direction in which the idler 7*b* pushes the loosened side B of the toothed belt 6. In this case, the slack of the toothed belt 6 is shifted to the tensioned side A, and the phase difference between the upper shaft 1 and the lower shaft 2 is caused in comparison with a case in which the idler unit 7 is located at the center position.

Figure 5:
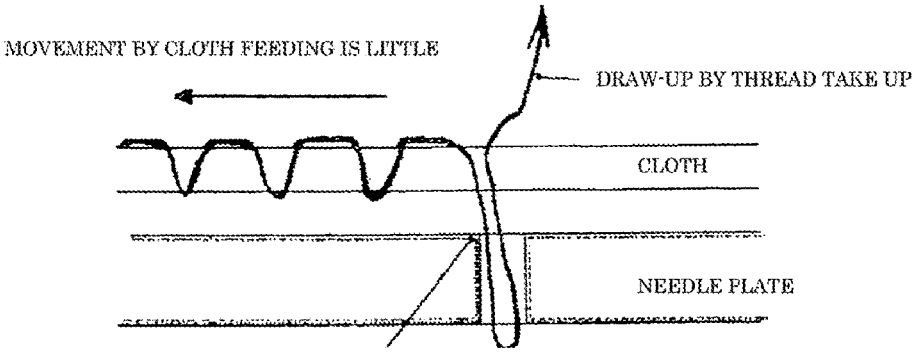
FIG. 5 is a diagram illustrating a condition of the needle thread drawn up by the thread take-up lever when the sewing machine is driven so as to retard the timing at which the cloth is fed.

When the idler unit 7 is moved to the right, the feeding phase of the lower shaft 2 is retarded relative to the thread take-up lever linked with the upper shaft 1. In this case, as illustrated in FIG. 5, the forward movement of the cloth becomes slow, and the amount of movement of the cloth becomes little. Hence, the needle thread is not held between the needle plate and the cloth. Accordingly, the thread take-up lever can smoothly draw up the needle thread, and thus a stitch becomes tighter in comparison with a case in which the idler unit 7 is located at the center position. Accordingly, by moving the idler unit 7 to the right if the cloth is thick, a firm stitch can be formed, thus improving the quality of needlework.

(3) Change in Tension when Tensioner is Applied

When the idler unit 7 is moved to the tensioned side A and the loosened side B, the slack of the belt absorbed by the idler unit 7 changes. That is, at a time point at which the idler unit 7 is moved to a predetermined right/left position, the tension of the toothed belt 6 becomes the maximum. When the idler unit 7 is moved at a fast speed, the tensioned condition of the toothed belt 6 is suddenly changed. A sudden change in the tensioned condition of the toothed belt 6 may decrease the durability of the toothed belt 6, and may cause vibrations and noises. In addition, the toothed belt 6 may be loosened and detached, and the meshing of the teeth between the upper-shaft pulley 1*a* and the lower-shaft pulley 2*a* may be mis-positioned.

The tension adjusting idler 8 is provided with the elastic member 8*a* that is the tensioner, and as illustrated in FIG. 3A, when the idler 7*a* is moved in a direction pushing the tensioned side A of the toothed belt 6, the tension adjusting idler 8 is pushed in a direction pushing the loosened side B of the toothed belt 6. As is clear from FIGS. 3A and 3B, the position where the tension adjusting idler 8 pushes the toothed belt 6 changes in accordance with a fluctuation in the absorbing level of the slack of the toothed belt 6 by the idler unit 7.

That is, as illustrated in FIG. 3B, when the absorbing level of the slack by the idler unit 7 is high and the tensioned condition of the toothed belt 6 is high, the pushing position of the tension adjusting idler 8 is shifted to the external side relative to the toothed belt 6, i.e., shifted in a direction in which the slack to be absorbed by the tension adjusting idler 8 becomes small. In addition, as illustrated in FIG. 3A, when the absorbing level of the slack by the idler unit 7 is low and the tensioned condition of the toothed belt 6 is not high, the pushing position of the tension adjusting idler 8 is shifted to the internal side relative to the toothed belt 6, i.e., shifted in a direction in which the slack to be absorbed by the tension adjusting idler 8 becomes large.

Figure 6:
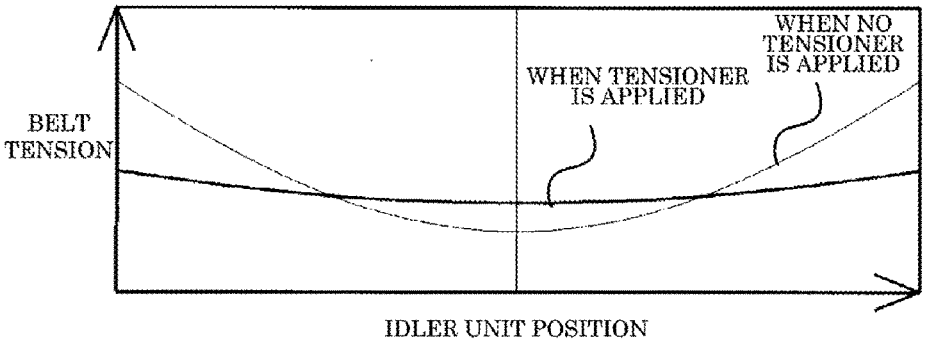
FIG. 6 is an explanatory diagram illustrating a change in tensioned condition of the belt when a tensioner is applied.

FIG. 6 illustrates a tensioned condition of the toothed belt 6 when the tension adjusting idler 8 linked with the elastic member 8*a* is applied. When the tension adjusting idler 8 is applied, the absorbing level of the slack by the tension adjusting idler 8 changes so as to maintain the sum of the absorbing level of the slack of the toothed belt 6 by the idler unit 7 and the absorbing level of the slack by the tension adjusting idler 8 at constant level. Hence, unlike the case in which a member equivalent to the tensioner is not provided, the tensioned condition is not suddenly changed, and thus a change level in the tensioned condition is remarkably eased.

(5) Operation of Restrictor

Figure 7:
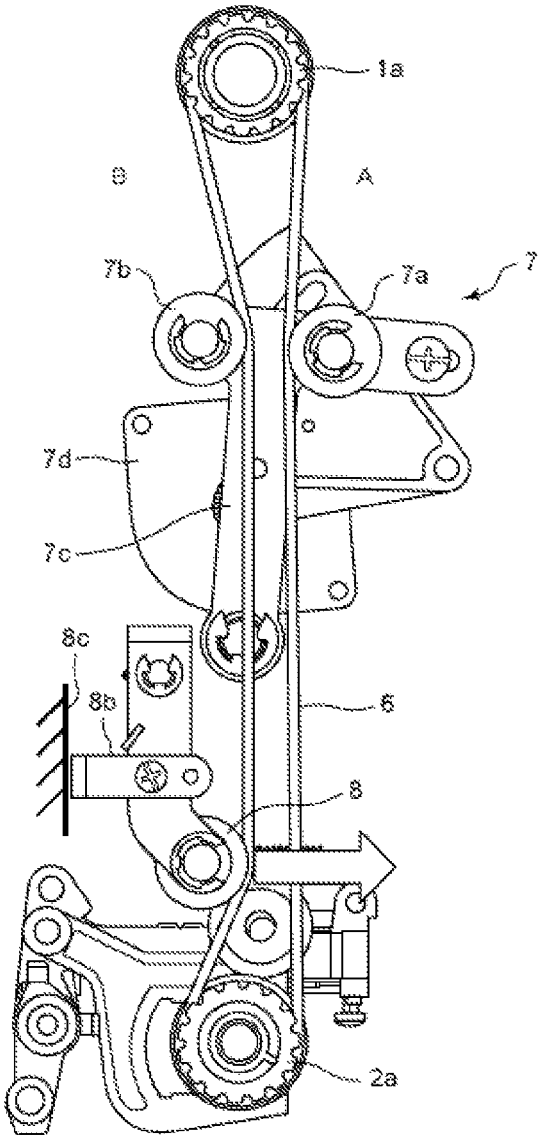
FIG. 7 is an explanatory diagram illustrating a condition in which the movable range of the tensioner is restricted by the restrictor.

Operations of the stopper arm 8*b* and the stopper 8*c* which serve as the restrictor will be explained with reference to FIG. 7. In the operation condition of a normal sewing machine, the tensioned side A of the toothed belt 6 and the loosened side B thereof are not interchanged. When, however, a sewing machine is actually operated by a user, for example, the bobbin thread is entangled and the hook is locked, and the upset user manually turns a flywheel in the reverse direction, unintentional load is caused. In this case, the tensioned side A of the toothed belt 6 and the loosened side B thereof may be temporarily interchanged.

When the tensioned side A of the toothed belt 6 and the loosened side B are interchanged by the occurrence of unintentional load, the tensioned condition of the toothed belt 6 increases beyond the pushing force by the elastic member 8*a*. In this case, as illustrated in FIG. 7, the stopper arm 8*b* collides with the stopper 8*c*, and the motion of the tension adjusting idler 8 is restricted to a certain position. When the movable range of the elastic member 8*a* is restricted as explained above, the toothed belt 6 is prevented from being loosened beyond the expected level. Hence, a tooth jumping of the toothed belt 6 is prevented, and thus the reference for the timing of the upper shaft 1 and the lower shaft 2 is maintained.

[1.3 Effects]

The sewing machine employing the above-explained structure according to this embodiment can accomplish the following effects.

(1) The sewing machine includes the upper shaft 1 rotatable so as to drive the needle bar, the lower shaft 2 rotatable so as to drive the feed dog 3, the upper-shaft pulley 1*a* provided for the upper shaft 1, the lower-shaft pulley 2*a* provided for the lower shaft 2, the belt 6 which links the upper-shaft pulley 1*a* with the lower-shaft pulley 2*a* and which synchronizes respective rotations, and the belt adjusting mechanism which contacts the belt 6 and which changes the belt length at the tensioned side A at which the belt 6 is drawn in. That is, by changing the belt length at the tensioned side A of the toothed belt 6 by the idler unit 7 that is the belt adjusting mechanism, the cloth feeding timing can be controlled as needed.

(2) When the belt adjusting mechanism changes the belt length at the tensioned side A so as to elongate it, the timing at which the feed dog 3 feeds the cloth is advanced. Hence, when the cloth to be sewn is thin, a cloth shrinkage can be suppressed, and when the cloth is thick, a firm stitch can be formed. That is, the timing at which the feed dog 3 feeds the cloth is controllable without a complicated adjustment work.

(3) The belt adjusting idler 8 linked with the elastic member 8*a* that serves as the tensioner pushes the loosened side B of the toothed belt 6, thereby remarkably reducing a fluctuation in the belt tension originating from a change in the slack absorbing level by the belt adjusting mechanism. Hence, an amount of change in the tensioned condition of the toothed belt 6 can be reduced without a complicated adjustment work. Accordingly, the toothed belt 6 is not loosed and is not disengaged, or the meshing of the toothed belt 6 with the pulleys is not disengaged and the teeth jumping is not caused, all of which are caused due to a change in tensioned condition. In addition, vibrations and noises can be suppressed. Therefore, the sewing machine can operate further stably.

(4) Because of variability of the axial center of the upper-shaft pulley 1*a* and that of the lower-shaft pulley 2*a*, and variability of the tensile strength of the toothed belt 6, the tension of the toothed belt 6 is uneven while the sewing machine is operated. In this embodiment, such an unevenness that cannot be absorbed by conventional idlers can be absorbed by finely changing the pushing position through the elongation/compression of the elastic member 8*a*.

(5) According to conventional sewing machines, a work of adjusting the slack of the toothed belt 6 and fixing the position of the idlers, etc., is necessary so as to obtain a predetermined tensioned condition of the toothed belt 6 when the toothed belt 6 is attached. According to this embodiment, however, the tensioned condition of the toothed belt 6 is adjustable through the elastic member 8*a*, and thus the attaching work of the toothed belt 6 can be simplified.

(6) Since the stopper arm 8*b* and the stopper 8*c* that serve as the restrictor are provided, when the tensioned condition of the toothed belt 6 increases and exceeds the pushing force by the tensioner, the movable range of the tensioner is restricted. When the motion of the tensioner is restricted by the restrictor, the toothed belt 6 is prevented from being elongated and loosened beyond the necessity. Therefore, teeth jumping of the toothed belt 6 is prevented, thereby suppressing a misalignment of the reference for the timing of the upper shaft 1 and the lower shaft 2.

[2. Other Embodiments]

The present invention is not limited to the aforementioned embodiment, and various modifications can be made as needed.

(1) In the aforementioned embodiment, the belt adjusting mechanism includes the idler unit 7 that includes the two idlers 7*a*, 7*b* which contact the tensioned side A of the toothed belt 6 and the loosened side B thereof, respectively. However, the structure employing the two idlers is for the safety purpose, and at least one idler may be provided at the tensioned side A of the toothed belt 6. In addition, the idler 7*b* at the loosened side B of the idlers 7*a*, 7*b* may be provided with a tensioner to accomplish the function of the tension adjusting idler 8. According to this structure, the number of components can be reduced, and the same advantageous effects as those of the aforementioned embodiment can be also accomplished.

(2) In the aforementioned embodiment, as the tensioner, the elastic member 8*a* that includes a spring is employed, and the stopper arm 8*b* and the stopper 8*c* are provided, but the function of the restrictor may be realized using a compression spring or a spring with a high spring constant. In addition, a finite-stroke spring with a stopper may be applied instead. Still further, when the shaft of the tension adjusting idler 8 is inserted in an elongated hole, the movable range thereof can be restricted within a predetermined range.

(3) The embodiment of the present invention was explained above, but various omissions, replacements, and modifications can be made without departing from the scope and spirit of the present invention. Such embodiments and modifications thereto are also within the scope and spirit of the present invention as recited in the appended claims, and also within the equivalent range thereto.

What is claimed is:

1. A sewing machine comprising:

an upper shaft rotatable so as to drive a needle bar;

a lower shaft rotatable so as to drive a feed dog;

an upper-shaft pulley provided for the upper shaft;

a lower-shaft pulley provided for the lower shaft;

a belt linking the upper-shaft pulley with the lower-shaft pulley to synchronize respective rotations;

a belt adjusting mechanism contacting the belt, and changing a belt length at a tensioned side of the belt where the belt is drawn in and a belt length at a loosened side of the belt where the belt is drawn in; and a tension adjusting idler applying force to the belt in accordance with a change in the belt length, wherein the belt adjusting mechanism comprises:

two idlers contacting to the belt at the tensioned side and the loosened side respectively;

an arm supporting two idlers; and a motor swinging the arm, wherein when the adjusting mechanism changes the belt length at the tensioned side so as to elongate the belt length, a feeding phase of the lower shaft is advanced relative to a thread take-up lever linked with the upper shaft, and when the adjusting mechanism changes the belt length at the loosened side so as to elongate the belt length, a feeding phase of the lower shaft is retarded relative to a thread take-up lever linked with the upper shaft.

2. The sewing machine according to claim 1, wherein the tension adjusting idler is provided at a loosened side of the belt where the belt is drawn out.

3. The sewing machine according to claim 1, wherein the tension adjusting idler comprises an elastic member.

4. The sewing machine according to claim 1, further comprising a restrictor restricting a movable range of the tension adjusting idler when a tensioned condition of the belt exceeds the force by the tension adjusting idler.

5. The sewing machine according to claim 4, wherein:

the restrictor comprises a stopper arm, and a stopper disposed with a predetermined distance from the stopper arm; and the stopper arm abuts the stopper when the tensioned condition of the belt exceeds the force by the tension adjusting idler, thereby restricting the movable range of the tension adjusting idler.

6. The sewing machine according to claim 2, wherein the tension adjusting idler comprises an elastic member.

7. The sewing machine according to claim 2, further comprising a restrictor restricting a movable range of the tension adjusting idler when a tensioned condition of the belt exceeds the force by the tension adjusting idler.

* * * * *